US006791502B2

(12) United States Patent
Apostolos et al.

(10) Patent No.: US 6,791,502 B2
(45) Date of Patent: Sep. 14, 2004

(54) STAGGER TUNED MEANDERLINE LOADED ANTENNA

(75) Inventors: John T. Apostolos, Merrimack, NH (US); Richard C. Ball, Loudon, NH (US)

(73) Assignee: Bae Systems Information and Electronic Systems Integration Inc, Nashua, NH (US)

( * ) Notice: Subject to any disclaimer, the term of this patent is extended or adjusted under 35 U.S.C. 154(b) by 0 days.

(21) Appl. No.: 10/279,183

(22) Filed: Oct. 23, 2002

(65) Prior Publication Data

US 2004/0080462 A1 Apr. 29, 2004

(51) Int. Cl.[7] ..... H01Q 11/12
(52) U.S. Cl. ..... 343/741; 343/742
(58) Field of Search ..... 343/741, 742, 343/744, 745, 866

(56) References Cited

U.S. PATENT DOCUMENTS

| | | | | |
|---|---|---|---|---|
| RE24,413 | E | 1/1958 | Weiss | |
| 5,790,080 | A | 8/1998 | Apostolos | 343/745 |
| 6,028,564 | A | 2/2000 | Duan et al. | 343/802 |
| 6,097,347 | A | 8/2000 | Duan et al. | 343/818 |
| 6,323,814 | B1 | 11/2001 | Apostolos | 343/744 |
| 6,373,440 | B2 | 4/2002 | Apostolos | 343/744 |
| 6,373,446 | B2 | 4/2002 | Apostolos | 343/797 |
| 6,384,792 | B2 | 5/2002 | Apostolos | 343/744 |
| 6,404,391 | B1 | 6/2002 | Apostolos | 343/700 MS |
| 2002/0024472 | A1 * | 2/2002 | Thursby et al. | 343/741 |

OTHER PUBLICATIONS

Grimes, Craig A., et al., A Clarification and Extension of "Bandwidth and Q of Antennas Radiating both TE and TM Modes", IEEE Transactions on Electromagnetic Compatibility, vol. 38,, No. 2, May 1996, pp. 201 & 202.

Grimes, Dale M. et al., Bandwidth and Q of Antennas Radiating TE and TM Modes, IEEE Transactions on Electromagnetic Compatibility, vol. 37, No. 2, May 1995, pp. 217–226.

Kim, Seong–Hwoon et al., Electrically Small, Mixed Modal Antenna (MMA) Array for Aerospace Applications, IEEE 1992, pp. 19–28.

TEFIKU, Faton et al., Design of Broad–Band and Dual–Band Antennas Comprised of Series–Fed Printed–Strip Dipole Pairs, IEEE Transactions on Antennas and Propagation, vol. 48, No. 6, Jun. 6, 2000, pp. 895–900.

Grimes, Craig A., Efficient Radiation From An Electrically Small Antenna: Control of Higher Order Modes, IEEE 1996, pp. 147–160.

Liu, Gang et al., FDTD and MoM Modeling of Power From Perpendiculary Oriented, Electrically Small TM Dipoles, IEEE 1998, pp. 542–545.

Grimes, Dale M. et al., The Q of Dipole, TM Radiation Fields, IEEE 1998, pp. 444–447.

Grimes, C.A.et al.., A Method for Determining The High Frequency , Small Signal BH Loop, IEEE 1999.

Grimes, Craig A. et al., Time and Frequency Domain Numerical Modeling of Outbound And Standing Power From Perpendicularly Oriented, Electrically Small TM Dipoles, IEEE 1998, pp. 265–272.

(List continued on next page.)

*Primary Examiner*—Hoang V. Nguyen
(74) *Attorney, Agent, or Firm*—Maine & Asmus

(57) ABSTRACT

A stagger tuned meanderline loaded antenna is disclosed. The antenna meanderlines are configured for manipulating the antenna's current null, which enables a combination of loop mode and monopole mode current distribution. The antenna quality factor can be adjusted substantially independent of antenna gain to achieve an extended Chu-Harrington relation.

25 Claims, 7 Drawing Sheets

OTHER PUBLICATIONS

Grimes, Dale M. et al.., The Q of Dipole, TM Radiation Fields, IEEE 1998, pp.255–263.

Grimes, Craig A. et al., An experimenatal Investigation Into the Control of Antenna Input Impedance Through Cancellation of Near Field Standing Energy, IEEE 1998, pp. 273–282.

Grimes, Craig A. et al., The Poynting Theorems and The Potential For Electrically Small Antennas, IEEE 1997, pp.161–176.

Badii, Vahid et al., Power and Energy in Small Biconical Transmitting Antennas, IEEE 1995, pp. 114–118.

Grimes, Dale M. et al., The Complex Poynting Theorem Reactive Power, Radiative Q, and Limitations on Electrically Small Antennas, IEEE 1995, pp. 97–101.

Grimes, Craig A. et al., Small antenna configurations: Implementation promises and problems, IEEE 1995, pp. 92–96.

Grimes , Dale M. et al., Transmission and Reception by Antennas*, IEEE 1995, pp. 83–97.

Grimes, Dale M. et al., Poynting's Theorem and Time–Harmonic Radiators, IEEE 1994, pp. 313–321.

Grimes, Dale M. et al. Poynting's Theorem, Reactive Energy, and Radiated Power, IEEE 1994, pp. 325–329.

Grimes, Craig A. et al., A Brief Discussion of EMI Shielding Materials, IEEE 1993, pp. 217–226.

Grimes, Craig A. et al., A Small Antenna with Aerospace Application, Unknown , pp. 1–10.

Grimes, Craig A. et al., The Effective Permability of Granular Thin Films, IEEE Transactions on Magnetics, vol. 26 No. 6, Nov. 1993, pp. 4092–4094.

* cited by examiner

STAGGER TUNED MEANDERLINE LOADED ANTENNA

FIELD OF THE INVENTION

The invention relates to antennas, and more particularly, to a stagger tuned meanderline loaded antenna.

BACKGROUND OF THE INVENTION

Efficient antennas typically require structures with minimum dimensions on the order of a quarter wavelength of their intended radiating frequency. Such dimensions allow an antenna to be easily excited and to be operated at or near its resonance, limiting the energy dissipated in resistive losses and maximizing the transmitted energy. These conventional antennas tend to be large in size at their resonant wavelengths. Moreover, as the operating frequency decreases, antenna dimensions tend to increase proportionally.

To address shortcomings of traditional antenna design and functionality, the meanderline loaded antenna (MLA) was developed. A detailed description of MLA techniques is presented in U.S. Pat. No. 5,790,080. Wideband MLAs are further described in U.S. Pat. Nos. 6,323,814 and 6,373,440, while narrowband MLAs are described in U.S. Pat. No. 6,373,446. An MLA configured as a tunable patch antenna is described in U.S. Pat. No. 6,404,391. Each of these patents is herein incorporated by reference in its entirety.

Generally, an MLA (also known as a "variable impedance transmission line" or VITL) is made up of a number of vertical and horizontal conductors. The vertical and horizontal sections are separated by gaps at certain locations. Meanderlines are connected between at least one of the vertical and horizontal conductors at the corresponding gaps. A meanderline is made up of alternating high and low impedance sections, and is designed to adjust the electrical (i.e., resonant) length of the antenna.

In addition, the design of the meanderlines provide a slow wave structure that permits lengths to be switched into or out of the circuit. Such switching changes the effective electrical length of the antenna with negligible electrical loss. The switching is possible because the active switching devices are located in the high impedance sections of the meanderline. This keeps the current through the switching section low, resulting in very low dissipation losses and high antenna efficiency.

A conventional meanderline loaded antenna generally provides a symmetrical coverage pattern (e.g., figure eight). Horizontal polarization, loop mode, is obtained when the antenna is operated at a frequency that is a multiple of the full wavelength frequency, which includes the electrical length of the entire line, comprising the meanderlines. Such an antenna can also be operated in a vertically polarized, monopole mode, by adjusting the electrical length to an odd multiple of a half wavelength at the operating a frequency. The meanderlines can be tuned using electrical or mechanical switches to change the mode of operation at a given frequency or to switch the frequency when operating in a given mode.

A general limitation on performance of antennas and radiating structures is governed by the Chu-Harrington relation for small lossy, conducting spheres: Efficiency= 64VQ where: Q=Quality Factor V=Volume of the structure in cubic wavelengths. Thus, antennas achieve an efficiency limit of the Chu-Harrington relation as their dimensions diminish. However, given the proliferation of applications using wireless technology, there is an on-going need for smaller and more efficient antennas.

What is needed, therefore, are techniques for improving antenna efficiency or otherwise extending the Chu-Harrington relation.

BRIEF SUMMARY OF THE INVENTION

One embodiment of the present invention provides a meanderline loaded antenna configured for stagger tuning. The antenna includes a first vertical radiator adapted with a feed point and having first and second ends. The first end is operatively coupled to a reference plane. The antenna further includes a second vertical radiator having first and second ends, with the first end operatively coupled to the reference plane at a distance from the first vertical radiator. A horizontal radiator having first and second edges is also included. The horizontal radiator is located in relation to the first and second vertical radiators so as to define a gap between each edge of the horizontal radiator and the second end of each vertical radiator. A pair of meanderlines is also included, with each interconnecting one of the vertical radiators to the horizontal radiator across the corresponding gap. The meanderlines are adapted for causing a combination of loop mode and monopole mode current distribution thereby enabling antenna quality factor adjustment substantially independent of antenna gain.

Another embodiment of the present invention provides a method for tuning a meanderline loaded antenna. The antenna is configured with a pair of vertical radiators spaced at a distance from each other, and a horizontal radiator is located in relation to the vertical radiators so as to define two gaps. A meanderline is connected between the horizontal radiator and the corresponding vertical radiator across each gap. The method includes decreasing delay associated with one of the meanderlines as compared to delay associated with the other meanderline thereby causing a combination of loop mode and monopole mode current distribution, and enabling antenna quality factor adjustment substantially independent of antenna gain. The method further includes monitoring antenna performance to determine if a desired gain and quality factor are achieved.

Another embodiment of the present invention provides a method of manufacturing a meanderline loaded antenna configured for stagger tuning. The method includes providing a pair of vertical radiators spaced at a distance from each other, with each vertical radiator having an upper edge. The method further includes providing a horizontal radiator having first and second edges, the horizontal radiator located in relation to the vertical radiators so as to define a gap between each edge of the horizontal radiator and the upper edge of each vertical radiator. The method also includes providing a pair of meanderlines, each meanderline interconnecting one of the vertical radiators to the horizontal radiator across the corresponding gap. Each meanderline is adapted to stagger tune the antenna thereby enabling antenna quality factor adjustment substantially independent of antenna gain.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Figure 1:
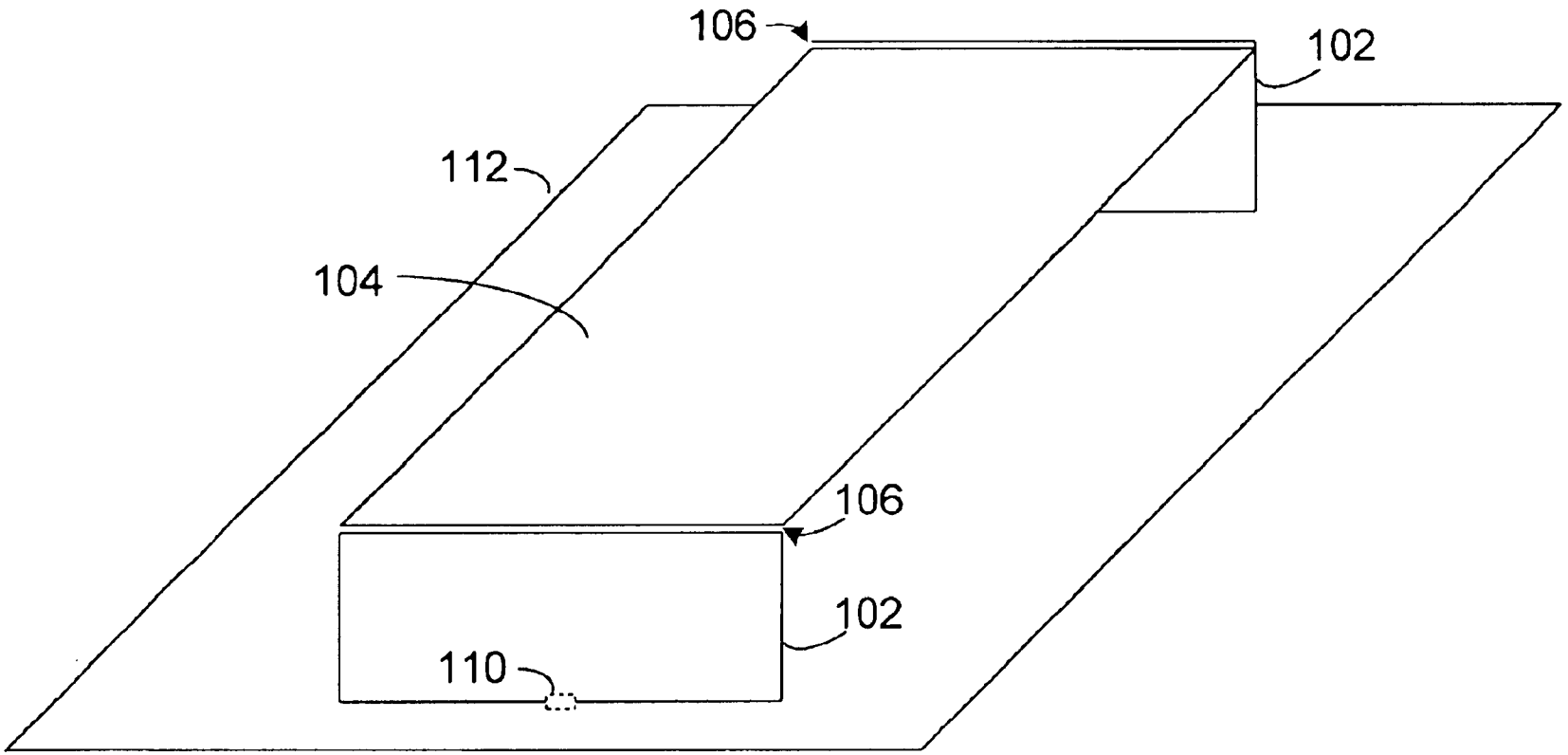
FIG. 1 illustrates a perspective view diagram of a meanderline loaded antenna configured in accordance with one embodiment of the present invention.

FIG. 1 illustrates a perspective view diagram of a meanderline loaded antenna configured in accordance with one embodiment of the present invention. A pair of vertical radiators 102 are connected to a conductive reference or ground plane 112, and extend substantially orthogonal from reference plane 112. A horizontal radiator 104 extends between the vertical radiators 102, but does not come in direct contact with the vertical radiators 102. Rather, gaps 106 are provided between the vertical radiators 102 and the horizontal radiator 104.

Note that one of the vertical radiators 102 is adapted to with a feed 110 (for receiving or transmitting). Right side and left side meanderlines (not visible in FIG. 1) are operatively coupled between the inside wall of each vertical radiator 102 and the underside of horizontal radiator 104 at each of gap 106. The meanderlines will be explained in more detail in reference to FIGS. 2 through 4*b*. Generally, the meanderlines can be manipulated thereby allowing the propagation delay through the antenna to be adjusted or tuned as desired.

Each of the ground plane 112, vertical radiators 102, and the horizontal radiator 104 can be implemented with a number of metal or alloy conductors, such as aluminum or copper. Fasteners (e.g., steel screws) or suitable conductive adhesives (e.g., solder or conductive epoxy) can be used to bond the radiators and ground plane in a given configuration. The ground plane 112 can be, for example, deposited on a printed circuit board (PCB) or other suitable medium, where a microwave I/0 port (e.g., SMA connector) is fastened to the PCB, and electrically coupled to one vertical radiator 102 so as to interface with the feed point 110.

Figure 2:
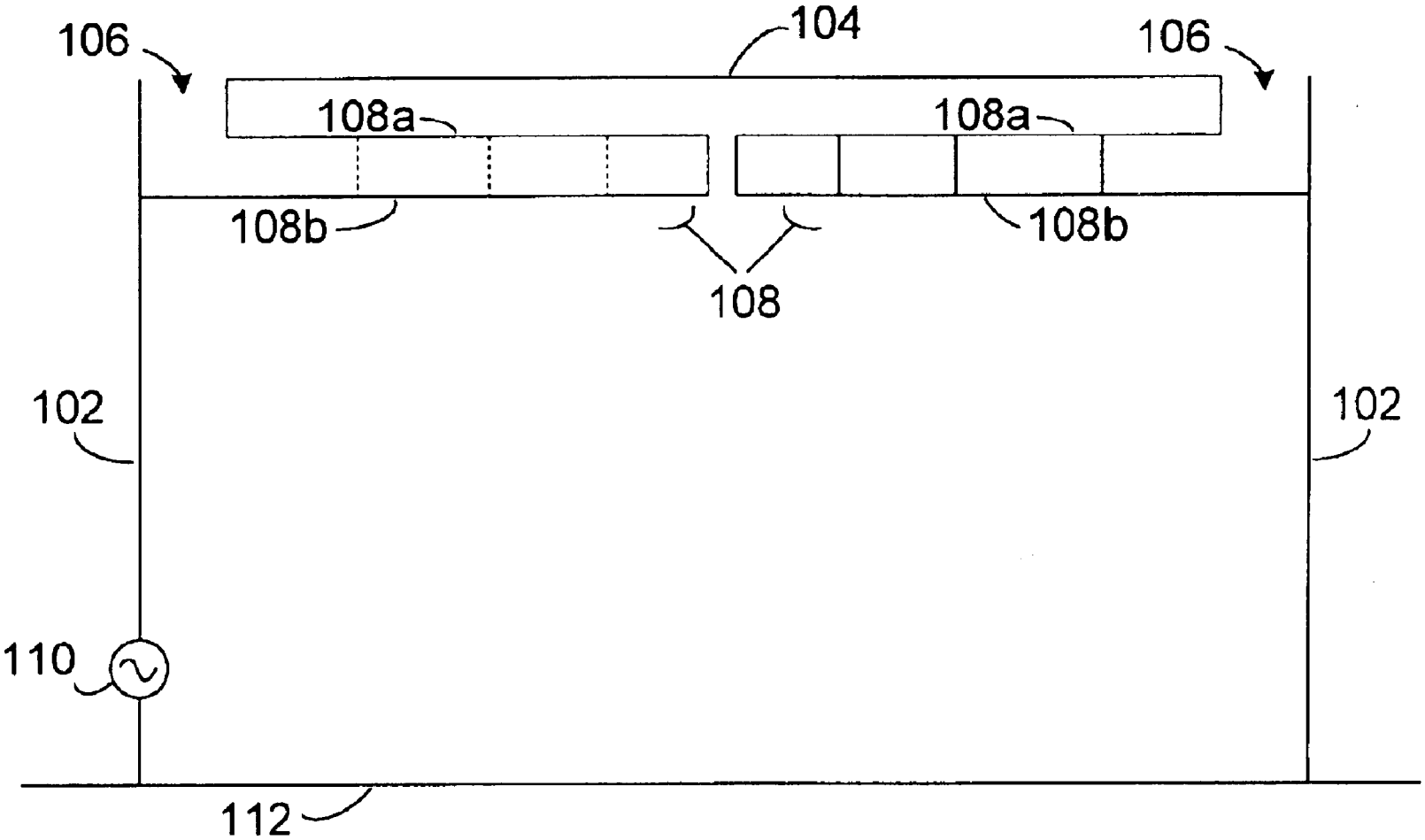
FIG. 2 illustrates a side view schematic of a meanderline loaded antenna of FIG. 1.

FIG. 2 illustrates a side view schematic of a meanderline loaded antenna of FIG. 1. As can be seen, the two vertical radiators 102 are separated from the horizontal radiator 104 by gaps 106. A meanderline 108 is connected between each vertical radiator 102 and the horizontal radiator 104. In particular, this embodiment includes a meanderline 108 having "fingers" of varying length on each side of the antenna structure. The meanderlines 108 can be used to tune the antenna into either a symmetrical or asymmetrical configuration.

For a symmetrical configuration, the right side and left side meanderlines 108 are tuned substantially the same. This condition results in a current null at the center of the horizontal conductor 104, and a null at the zenith characteristic of monopole antennas. In such a configuration, the normal Chu-Harrington relation applies. Thus, the antenna Efficiency equals FVQ where F is equal to 64 for a cube or sphere. However, an asymmetric configuration is also possible, where the right side and left side meanderlines 108 are tuned differently, or "stagger tuned."

Generally stated, stagger tuning includes adjusting the meanderline 108 of one side to have a shorter delay than the meanderline 108 of the other side. Such tuning causes a combination of loop mode and monopole mode current distribution. The current null is no longer centered on the horizontal radiator 104, but is effectively moved to inside the meanderline 108 associated with the longer delay. As a result, the antenna bandwidth can be increased by about a factor of two with negligible impact on antenna gain. The mixture of loop and monopole currents provides this beneficial effect, and the Chu-Harrington relation is effectively extended.

Figure 3:
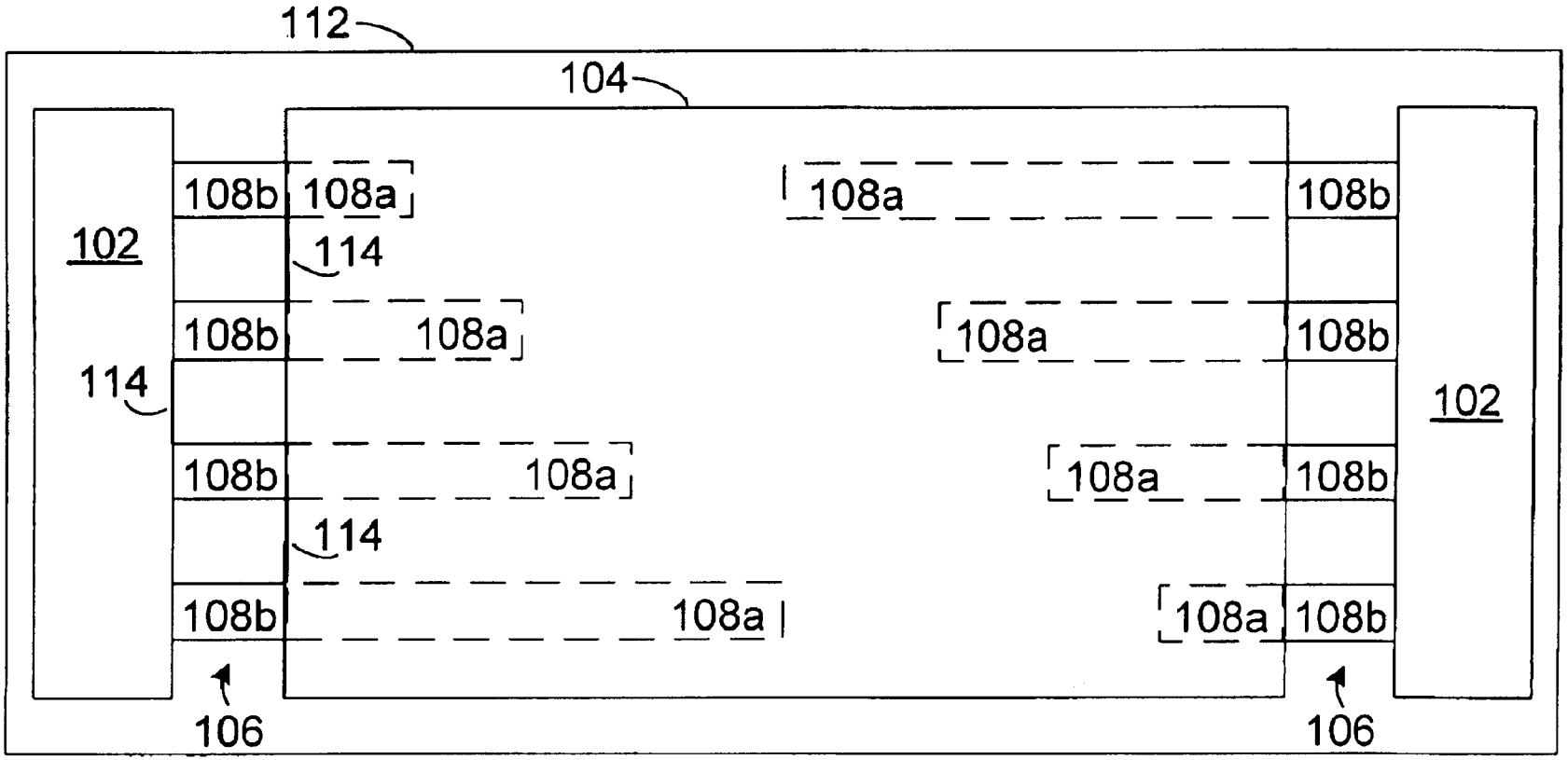
FIG. 3 illustrates a top view schematic of a meanderline loaded antenna of FIG. 1.

Referring to the side view depicted in FIG. 2, left and right side meanderlines 108 can be seen. On the left side, the longest finger of meanderline 108 is visible, with the second, third, and fourth fingers hidden from view, but indicated with dashed lines. On the right side, each of the four fingers of the meanderline 108 are visible, with the shortest finger in the forefront and the second, third, and fourth fingers behind it in length-based order. FIG. 3 further illustrates the right and left side meanderlines 108 from a top view perspective.

Each meanderline 108 finger includes a low impedance section 108*a* and a high impedance section 108*b*. The impedance of each section is relative to the horizontal radiator 104. The closer in distance that the meanderline 108 section is to the horizontal radiator 104, the lower the impedance of that section. Likewise, the further in distance the meanderline 108 section is from the horizontal radiator 104, the higher the impedance of that section.

The meanderlines 108 can be implemented, for example, with ribbon copper, aluminum foil, or other suitable, flexible conductor material. Such conductive material can be manipulated to a particular position or shape and will generally not move from that position unless disturbed. The connection points of the meanderlines 108 to the horizontal radiator 104 and vertical radiators 102 can be achieved with a solder or other suitable conductive adhesive.

Alternatively, a meanderline 108 can be deposited on the top and bottom sides of a PCB. Connections from the PCB meanderline to the respective radiators can be made with appropriate interconnects or wiring (e.g., wire bonds, copper wire, or solder bump bonds). Other techniques for providing the meanderlines 108 will be apparent in light of this disclosure, and the present invention is not intended to be limited to any one such technique.

Note that a dielectric material may be deployed between the low impedance sections 108*a* of the meanderlines 108 and the respective horizontal radiators 104. A dielectric of air is demonstrated in the embodiment depicted. Further note that the meanderline 108 on a given side is one continuous conductor (such as a flexible ribbon conductor) that is shaped into the length ordered fingers and connected to the radiators accordingly.

FIG. 3 illustrates a top view schematic of a meanderline loaded antenna of FIG. 1. As can be seen, the vertical radiators 102 and horizontal radiator 104 are spatially related so as to define gaps 106 as previously discussed. In addition, the right and left side meanderlines 108 are coupled across the gaps 106 as shown, with low impedance sections connected near the respective edge of the horizontal radiator 104, and the high impedance sections 108*b* connected to the upper edge of the corresponding vertical radiator 102.

Note that the left and right side meanderlines 108 are configured similarly so as to provide symmetry when so desired. The shape of the meanderline 108 deployed on each side will depend on factors such as the operating frequency, and the desired delay characteristics and tuning range (e.g., minimum delay, delay resolution, maximum delay). In this embodiment, each meanderline 108 includes four fingers of varying length to provide a wide tuning range. The fingers of one meanderline are positioned in reverse association with the fingers of the other meanderline. Thus, the longest finger of one meanderline 108, for instance, corresponds to the shortest finger of the other meanderline 108.

Further note that each meanderline 108 includes carry over portions, each carry over portion connecting one finger of the meanderline to the next length finger at the edge of the respective radiator near gap 106. As will be appreciated, the carry over portions will alternate from the horizontal radiator 104 edge to the corresponding vertical radiator 102 edge in order to maintain the continuity of the conductor making up the fingers of the meanderline 108. Example carry over portions are designated 114 in FIG. 3.

In one embodiment, the antenna structure dimensions are as follows: 12 inches high (from reference plane 112 to the horizontal radiator 104); 36 inches long (from one vertical radiator 102 to the other); and 12 inches wide (from one vertical edge of a radiator 102 to the other vertical edge of that radiator 102). The conductive reference plane can be 12 by 36 inches or larger to accommodate the vertical and horizontal radiators of the structure.

Each meanderline 108 finger is approximately 0.5 to 1.5 inches wide, with the lengths as follows: 18 inches, 13.5 inches, 9 inches and 4.5 inches. These lengths are ordered from the longest to the shortest finger for each side of the structure, and are measured from the corresponding vertical radiator 102 to the turnaround point of the finger (where the low impedance section 108*a* turns into the high impedance section 108*b*). The connection points of each meanderline 108 are made with solder proximate the edge (e.g., within ⅛ inch) of the corresponding radiator.

In addition, the meanderline 108. fingers are spaced approximately 1 to 2 inches from each other, with the shortest and longest fingers spaced approximately 1 to 2 inches inward from the respective long edge of the horizontal radiator 104. The operating frequency can vary significantly as will be appreciated, but this particular embodiment was tested from 15 MHz to 25 MHz.

The preceding dimensions and ranges are not intended as limitations on the present invention. Rather, they merely correspond to one embodiment. Numerous antenna configurations, operating frequency ranges, and structure dimensions are possible in light of this disclosure.

Figure 4A:
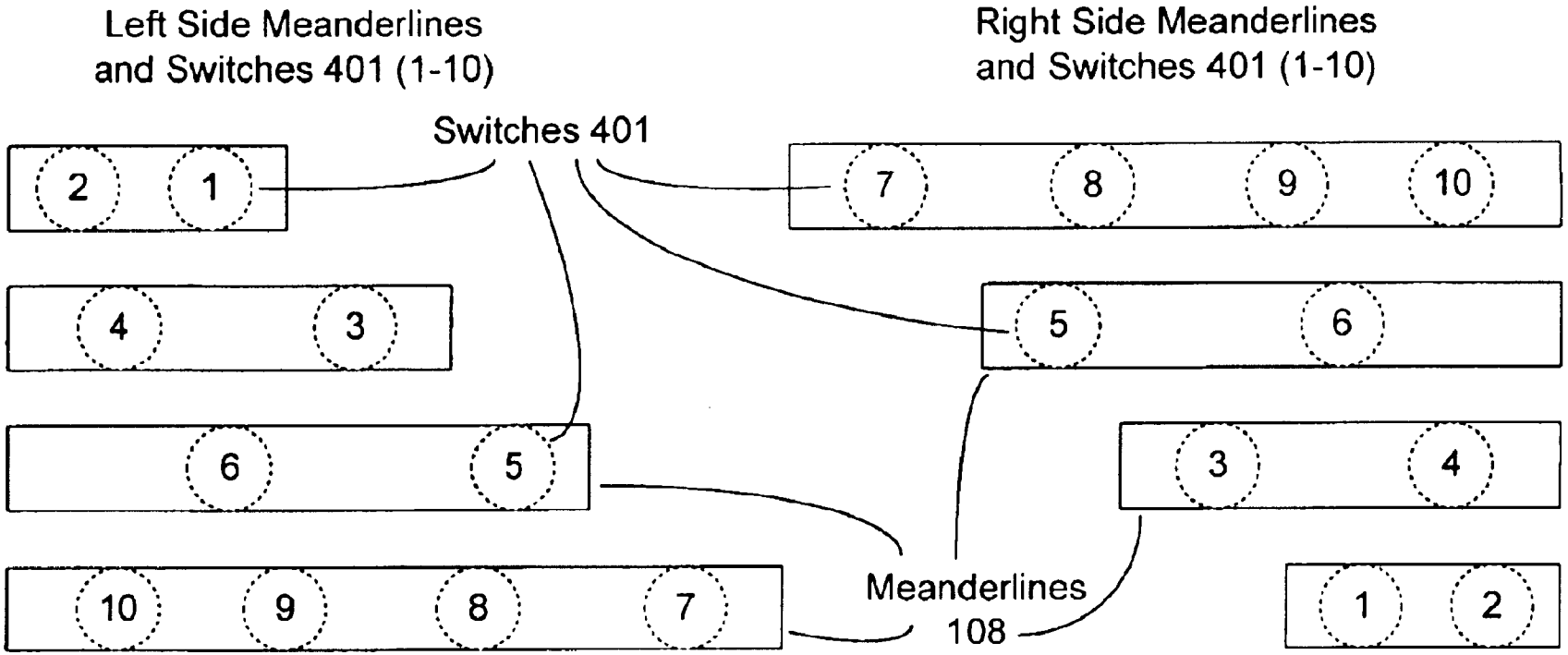
FIG. 4*a* illustrates a top view schematic of a meanderline loaded antenna configured with a switching scheme in accordance with one embodiment of the present invention.

FIG. 4*a* illustrates a top view schematic of a meanderline loaded antenna configured with a switching scheme in accordance with one embodiment of the present invention. The switching scheme includes a number of switches 401 on both the left and right side meanderlines 108.

In particular, the shortest finger of each meanderline 108 is associated with switches 1 and 2; the next length finger of each side is associated with switches 3 and 4; the next length finger of each side is associated with switches 5 and 6; and the longest finger of each side is associated with switches 7, 8, 9, and 10. For purposes of symmetrical tuning, the switches can be deployed in a similar configuration on each side, but need not be to practice the present invention.

Figure 4B:
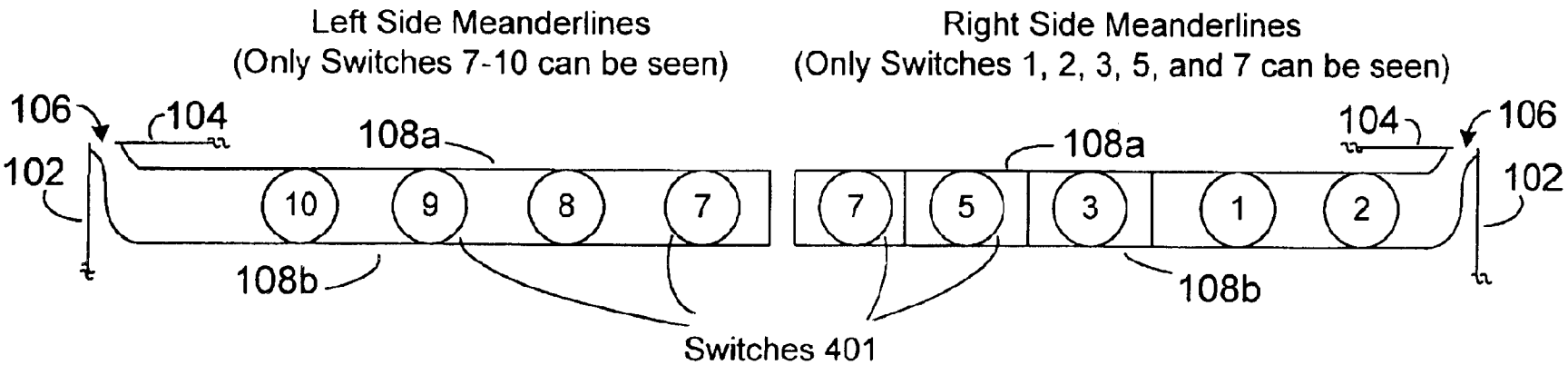
FIG. 4*b* illustrates a side view schematic of a meanderline loaded antenna of FIG. 4*a*.

FIG. 4*b* illustrates a side view schematic of a meanderline loaded antenna of FIG. 4*a*. Note that on the left side meanderline 108, only switches 7, 8, 9, and 10 can be seen, as the other left side switches (1–6) are hidden from view behind the meanderline's longest finger. On the right side meanderline 108, switches 1 and 2 of the shortest finger can be seen, along with switch 3 of the next longest finger, switch 5 of the next longest finger, and switch 7 of the longest finger.

Each of the switches 401 is operatively coupled between the low impedance section 108*a* and the high impedance section 108*b* of the corresponding finger. If a particular switch is turned on or otherwise activated, then the low impedance section 108*a* is effectively short-circuited to the high impedance section 108*b* at that switching point. Thus, the propagation delay through that meanderline 108 is proportionately decreased.

Note that even though the portion of the meanderline 108 that is short-circuited is effectively removed from the transmission path, a residual impedance associated with that removed section may remain. As such, activating a switch in the short-circuited section may provide additional decrease in delay. For example, assume that switch 2 of the shortest finger on the right side is activated thereby short-circuiting the remaining portion of the that meanderline 108, including switch 1. Activating switch 1 may nonetheless provide additional decrease in delay. The degree of this additional change in delay depends on factors such as the frequency of operation and the type of switching technology employed.

Alternatively, the switches 401 can be connected such that when activated, they short-circuit a portion of a low impedance section 108*a* or a high impedance section 108*b*. In one such embodiment, one or more of the switches 401 are serially connected on the high impedance sections 108*b*. Configuring the switches in this manner provides low switch losses, and allows for adjustment of series capacitance needed to cancel the meanderline inductance.

A combinational switching scheme can also be employed, where one or more switches for short-circuiting serial capacitance associated with a particular low or high impedance section (e.g., 108*a* or 108*b*) are used in conjunction with one or more switches for short-circuiting a low impedance section 108*a* to a high impedance section 108*b*. Other switching schemes are possible as well.

The switches 401 may be implemented in a number of technologies. For instance, conventional microelectromechanical systems (MEMS) switches, diodes, relays, or any other switching device suitable for operation at the operating frequency of the antenna. Control for the switching scheme can be provided, for example, manually by an operator.

Alternatively, the switch control can be provided by a computer or other suitable processing system programmed or otherwise configured to control the switches 401. An I/O control card included in the system can be employed to manifest the programmed control signals that are applied to switches 401. The system can be further adapted to automatically receive input stimulus based on the antenna performance, and programmed to selectively enable certain switches 401 based on that stimulus so as to optimize the antenna tuning. A tuning algorithm that receives the stimulus and provides the control can be developed and refined based on, for instance, historical performance data associated with the particular antenna application.

Extended Chu-Harrington Relation

Recall that the Chu-Harrington limit for small lossy, conducting spheres is expressed by the relation: Efficiency=

64QV, where Q is the quality factor and V is the volume of the structure in cubic wavelengths. The above relation can be modified to: Efficiency=FQV, where F is a form factor. For a sphere, K equals 64. K can be calculated for rectangular solids, which is the shape of many meanderline loaded antennas. This extended relationship, which has been corroborated experimentally for a wide range of rectangular solids, is extremely useful in predicting the performance available in space constrained environments.

For purposes of discussion, consider the following embodiment: a meanderline loaded antenna in the shape of a rectangular solid having the structural dimensions of 12×12×36 inches (as previously discussed in reference to FIG. 3). The input and output meanderlines each have four fingers. The fingers are 1.25 inches wide, with finger lengths as follows: 18 inches, 13.5 inches, 9 inches and 4.5 inches (as previously discussed in reference to FIGS. 3, 4*a*, and 4*b*). The fingers are spaced approximately 1.25 inches from each other, with the shortest and longest fingers spaced approximately 1.625 inches inward from the respective long edge of the horizontal radiator 104.

For purposes of clarity, and with reference to FIGS. 1 and 2, note that the "left side" corresponds to the feed point 110. In this sense, the left side meanderline 108 is referred to herein as the input meanderline 108, while the right side meanderline 108 is referred to as the output meanderline 108. An opposite relationship would exist for the receiving direction.

With symmetric tuning, the antenna operates in monopole mode, and the expected Chu-Harrington limit on efficiency and bandwidth is in effect. In a symmetric case, the same switches 401 will be enabled on both the right and left side. For example, switches 1, 2, and 3 might be enabled on both sides to provide a symmetric tuning. Similarly, no enabled switches on either side would provide a symmetric tuning. Regardless of the actual symmetric tuning, the resulting current null is centered on the horizontal radiator 104.

For this particular antenna structure, a form factor of about 45 was achieved with symmetrical tuning. Experimental gains in the 15 to 25 MHz range predicted by the Chu-Harrington formula were confirmed with actual measurement.

An example asymmetric or stagger tuned case might be where the left side meanderline 108 has no switches enabled and the right side meanderline 108 has switches 1, 3, and 4 enabled. Such staggered tuning of the input and output meanderlines causes the output meanderline 108 to have a shorter delay as compared to the delay provided by the input meanderline 108. This gives rise to a combination of loop mode and monopole mode current distribution.

In particular, the current null is no longer centered on the horizontal radiator 104 of the structure, but is inside the input meanderline 108. As a result of de-centering the current null, the antenna quality factor can be reduced by up to a factor of two or more. Given the inverse relationship between Q and bandwidth, the bandwidth can be increased by about a factor of two or more. Note that the switches 401 associated with longer fingers of the meanderline 108 will generally have a greater impact on performance than the switches 401 associated with the shorter meanderline 108 fingers.

To achieve an optimal quality factor, the switches 401 can be manipulated while monitoring the antenna performance (e.g., gain, efficiency, and quality factor). The monitoring can be accomplished, for example, by observing, measuring, or calculating the resulting antenna gain and quality factor for each set of switch 401 positions. Test equipment such as network analyzers can be employed to measure various performance parameters of the antenna. It will be appreciated that other relevant information can be calculated or otherwise derived from observed or measured information. The manipulating and monitoring can be repeated a number of times until a desired gain and quality factor are achieved.

Figure 5A:
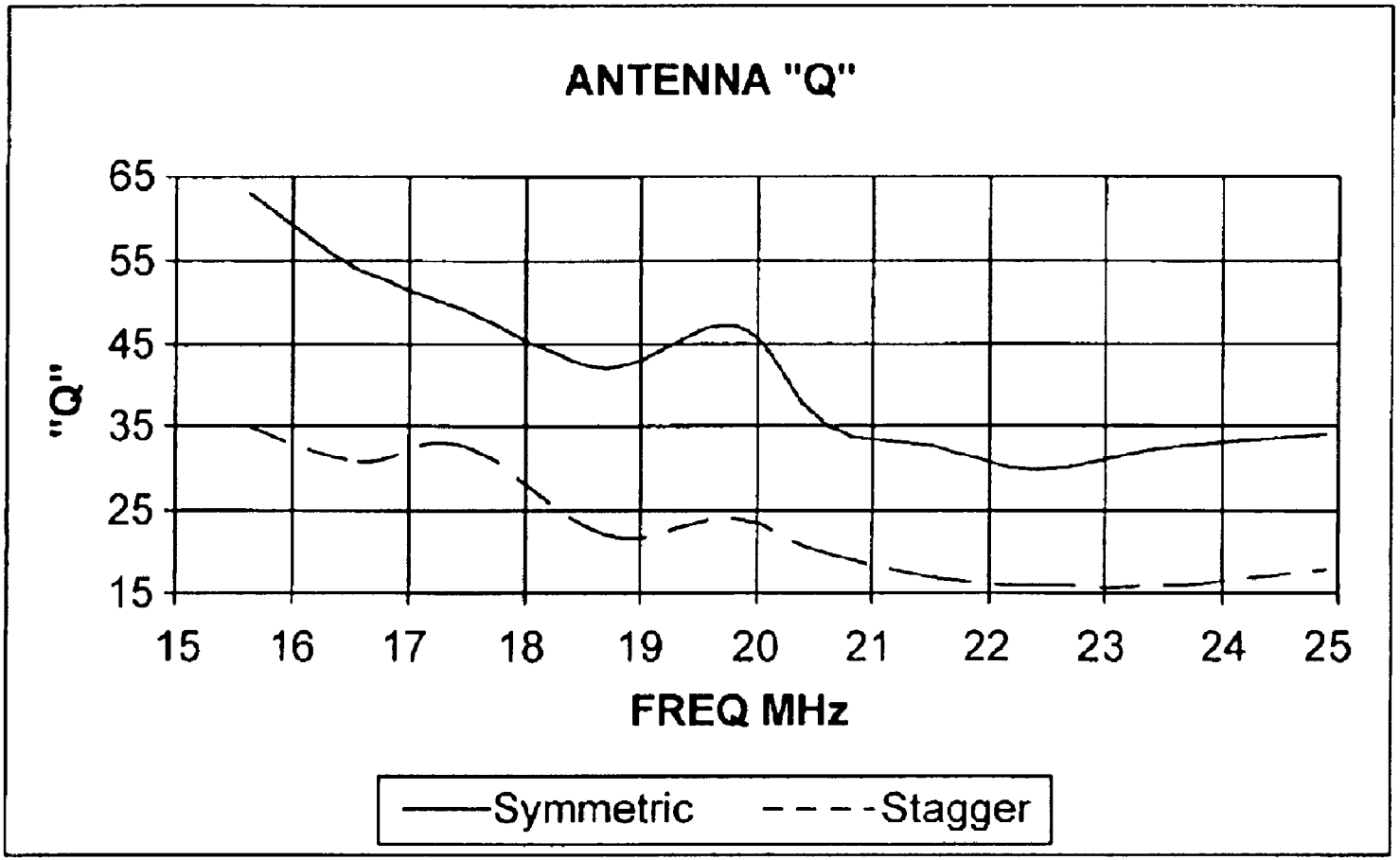
FIGS. 5*a* and 5*b* graphically illustrate an improvement of antenna efficiency realized for an antenna configured in accordance with one embodiment of the present invention.
Figure 5B:
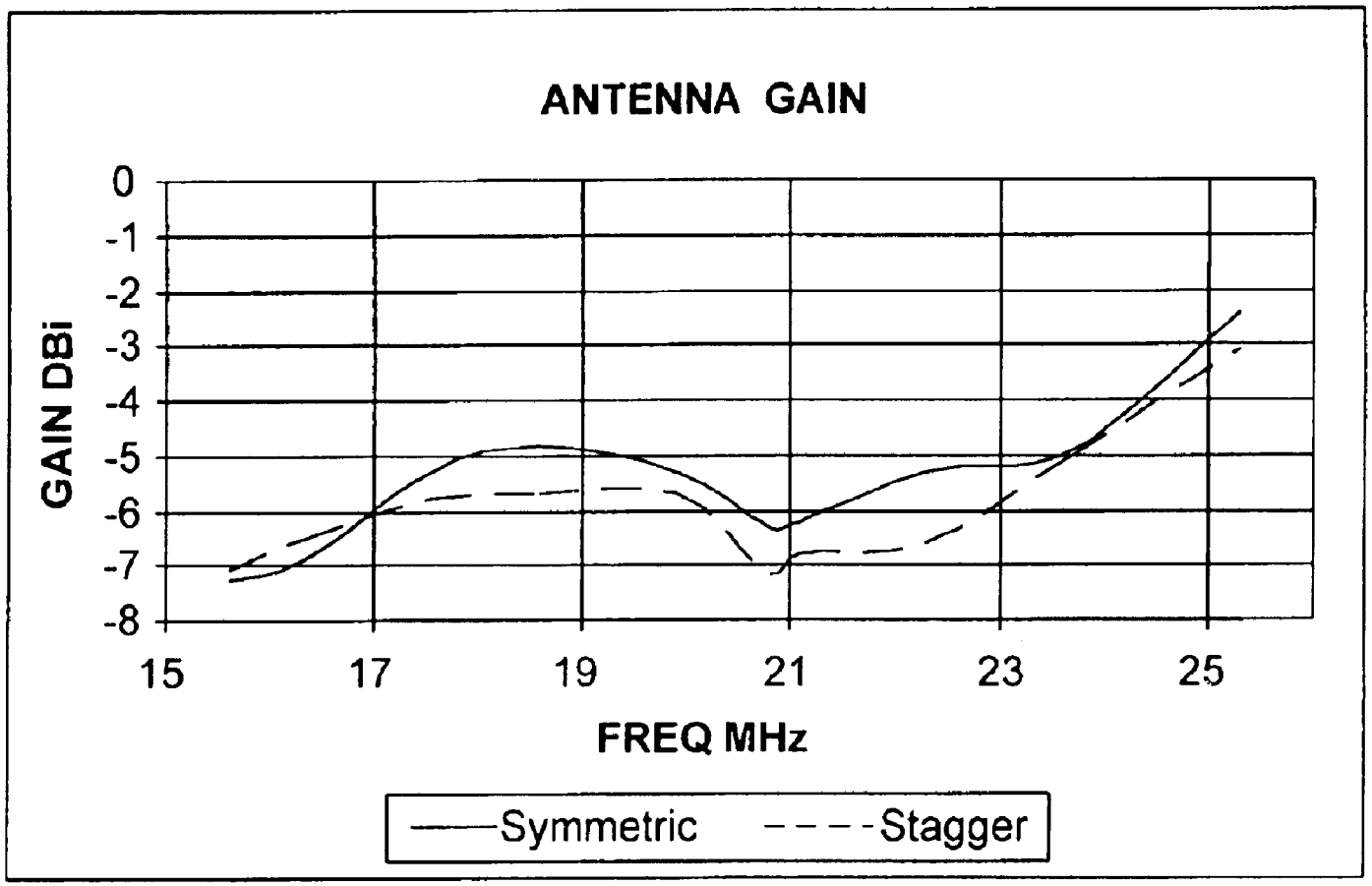

FIGS. 5*a* and 5*b* graphically illustrate a quality factor improvement with negligible impact on gain realized for the stagger tuned antenna as compared to the symmetrically tuned antenna. As can be seen in FIG. 5*a*, the quality factor of the stagger tuned antenna is reduced by about a factor of two in comparison to the symmetrically tuned antenna. Note that for resonant antennas, the Q is approximately the inverse of the antenna's fractional bandwidth. Thus, the antenna bandwidth is increased by about a factor of two.

In addition, FIG. 5*b* illustrates a negligible impact on the antenna gain. Thus, the efficiency of the stagger tuned antenna essentially remains constant as compared to the symmetrically tuned antenna. The volume also remains constant, where the dimensions of the rectangular solid are 12×12×36 inches for both the symmetric and asymmetric configurations.

Working from the Chu-Harrington relation, the form factor (referred to here as the figure of merit, FOM) can be determined with: Efficiency/VQ. A FOM of about 100 was provided with this stagger tuned structure. Thus, staggered tuning as described herein allows antenna quality factor adjustment substantially independent of antenna gain, and an extended Chu-Harrington relation is achieved.

The foregoing description of the embodiments of the invention has been presented for the purposes of illustration and description. It is not intended to be exhaustive or to limit the invention to the precise form disclosed. Many modifications and variations are possible in light of this disclosure. For example, numerous antenna structures and configurations may be stagger tuned in accordance with the principles of the present invention. In addition, the principles of the present invention can be applied to both transmitting and receiving antennas. It is intended that the scope of the invention be limited not by this detailed description, but rather by the claims appended hereto.

What is claimed is:

1. A meanderline loaded antenna configured for stagger tuning, the antenna comprising:

a horizontal reference plane;

a first vertical radiator adapted with a feed point and having first and second ends, the first end operatively coupled to the reference plane;

a second vertical radiator having first and second ends, the first end operatively coupled to the reference plane at a distance from the first vertical radiator;

a horizontal radiator having first and second edges, the horizontal radiator located in relation to the first and second vertical radiators so as to define a gap between each edge of the horizontal radiator and the second end of each vertical radiator; and a pair of meanderlines, each interconnecting one of the vertical radiators to the horizontal radiator across the corresponding gap, and each associated with a number of fingers having a length-based order ranging from a shortest finger to a longest finger, wherein the meanderlines are adapted for causing a combination of loop mode and monopole mode current distribution thereby enabling antenna quality factor adjustment substantially independent of antenna gain.

2. The antenna of claim 1 wherein each of the fingers has a high impedance section and a low impedance section relative to the horizontal radiator.

3. The antenna of claim 1 wherein one meanderline is an input meanderline, and the other meanderline is an output meanderline, and delay associated with the output meanderline is decreased thereby causing a current null to move into the input meanderline.

4. The antenna of claim 1 wherein the fingers of one meanderline are positioned in reverse association with the fingers of the other meanderline.

5. The antenna of claim 1 wherein each meanderline includes a number of switches adapted for short-circuiting a portion of the meanderline thereby decreasing delay through the meanderline.

6. The antenna of claim 5 wherein the switches include at least one of microelectromechanical systems switches, diodes, and relays.

7. The antenna of claim 1 wherein decreasing delay associated with one meanderline to be less than delay associated with the other meanderline causes the combination of loop mode and monopole mode current distribution.

8. The antenna of claim 1 wherein decreasing delay associated with one meanderline to be less than delay associated with the other meanderline causes a shift in antenna current null causing the combination of loop mode and monopole mode current distribution.

9. The antenna of claim 1 wherein the antenna is capable of achieving a form factor that exceeds Chu-Harrington limitations.

10. A method for tuning a meanderline loaded antenna having a pair of vertical radiators spaced at a distance from each other, and a horizontal radiator located in relation to the vertical radiators so as to define two gaps, with a meanderline connected between the horizontal radiator and the corresponding vertical radiator across each gap, the method comprising:

decreasing delay associated with one of the meanderlines as compared to delay associated with the other meanderline thereby causing a combination of loop mode and monopole mode current distribution and enabling antenna quality factor adjustment substantially independent of antenna gain;

monitoring antenna performance to determine if a desired gain and quality factor are achieved; and repeating the decreasing and monitoring a number of times until the desired gain and quality factor are achieved.

11. The method of claim 10 wherein the decreasing the delay associated with one of the meanderlines includes short-circuiting portions of the meanderline thereby decreasing delay through the meanderline.

12. The method of claim 10 wherein decreasing the delay associated with one of the meanderlines includes activating one or more switches that short-circuit portions of the meanderline thereby decreasing delay through the meanderline.

13. The method of claim 10 wherein decreasing delay associated with one of the meanderlines includes causing a shift in antenna current null.

14. The method of claim 10 wherein the decreasing and monitoring are repeated a number of times until a form factor is achieved that exceeds Chu-Harrington limitations.

15. The method of claim 10 wherein one meanderline is an input meanderline, and the other meanderline is an output meanderline, and decreasing the delay associated with one of the meanderlines includes decreasing the delay of the output meanderline which causes a current null to move into the input meanderline.

16. A method of manufacturing a meanderline loaded antenna configured for stagger tuning, the method comprising:

providing a pair of vertical radiators spaced at a distance from each other, each vertical radiator having an upper edge;

providing a horizontal radiator having first and second edges, the horizontal radiator located in relation to the vertical radiators so as to define a gap between each edge of the horizontal radiator and the upper edge of each vertical radiator; and providing a pair of meanderlines, each associated with a number of fingers having a length-based order ranging from a shortest finger to a longest finger, and each interconnecting one of the vertical radiators to the horizontal radiator across the corresponding gap, wherein each meanderline is adapted to stagger tune the antenna thereby enabling antenna quality factor adjustment substantially independent of antenna gain.

17. The method of claim 16 further including:

positioning the fingers of one meanderline in reverse association with the fingers of the other meanderline.

18. The method of claim 16 further including:

providing one or more switches adapted for short-circuiting a portion of meanderline thereby enabling a decrease in delay through that meanderline.

19. The method of claim 16 further comprising configuring the antenna for symmetric tuning.

20. The method of claim 16 wherein the antenna is capable of achieving a form factor that exceeds Chu-Harrington limitations.

21. A meanderline loaded antenna configured for stagger tuning, the antenna comprising:

a first meanderline adapted to interconnect a first vertical radiator to a horizontal radiator across a first gap between an edge of the horizontal radiator and a corresponding edge of the first vertical radiator; and a second meanderline adapted to interconnect a second vertical radiator spaced from the first vertical radiator to the horizontal radiator across a second gap between an opposite edge of the horizontal radiator and a corresponding edge of the second vertical radiator;

wherein each meanderline is associated with a number of fingers having a length-based order ranging from a shortest finger to a longest finger, thereby enabling stagger tuning of the antenna.

22. The antenna of claim 21 wherein delay associated with one of the meanderlines can be manipulated to cause a current null to move into the other meanderline.

23. The antenna of claim 21 wherein the fingers of one meanderline are positioned in reverse association with the fingers of the other meanderline.

24. The antenna of claim 21 wherein decreasing delay associated with one meanderline to be less than delay associated with the other meanderline causes a combination of loop mode and monopole mode current distribution.

25. The antenna of claim 21 wherein the antenna is capable of achieving a form factor that exceeds Chu-Harrington limitations.

* * * * *